United States Patent [19]

Huang et al.

[11] Patent Number: 4,764,226

[45] **Date of Patent: * Aug. 16, 1988**

[54] $NI_3A1$ ALLOY OF IMPROVED DUCTILITY BASED ON IRON AND NIOBIUM SUBSTITUENT

[75] Inventors: Shyh-Chin Huang, Latham; Keh-Minn Chang; Alan I. Taub, both of Schenectady, all of N.Y.

[73] Assignee: General Electric Company, Schenectady, N.Y.

[ * ] Notice: The portion of the term of this patent subsequent to Oct. 23, 2001 has been disclaimed.

[21] Appl. No.: 783,722

[22] Filed: Oct. 3, 1985

[51] Int. Cl.[4] ..... C22C 19/03

[52] U.S. Cl. ..... 148/429; 420/459

[58] Field of Search ..... 148/429, 4; 420/460, 420/459

[56] References Cited

U.S. PATENT DOCUMENTS 4,478,791 10/1984 Huang et al. ..... 420/460

OTHER PUBLICATIONS

C. T. Liu & C. C. Koch, "Development of Ductile Polycrystalline $Ni_3Al$ for High-Temperature Applications", Technical Aspects of Critical Materials Use by the Steel Industry, NBSIR 83-2679-2, vol. IIB (Jun. 1983), Center for Materials Science, U.S. Dept. of Commerce, Nat'l Bureau of Standards.

*Primary Examiner*—R. Dean

*Attorney, Agent, or Firm*—Paul E. Rochford; James C. Davis, Jr.; James Magee, Jr.

[57] ABSTRACT

A melt is provided having the formula $$(Ni_{0.76}Al_{0.24-x}Nb_x)_{89.75}Fe_{10}B_{0.25}.$$

The melt is rapidly solidified as ribbon and the ribbon is annealed at about 1100° C. Desirable properties are found when x is between 0.02 and 0.10.

7 Claims, 1 Drawing Sheet

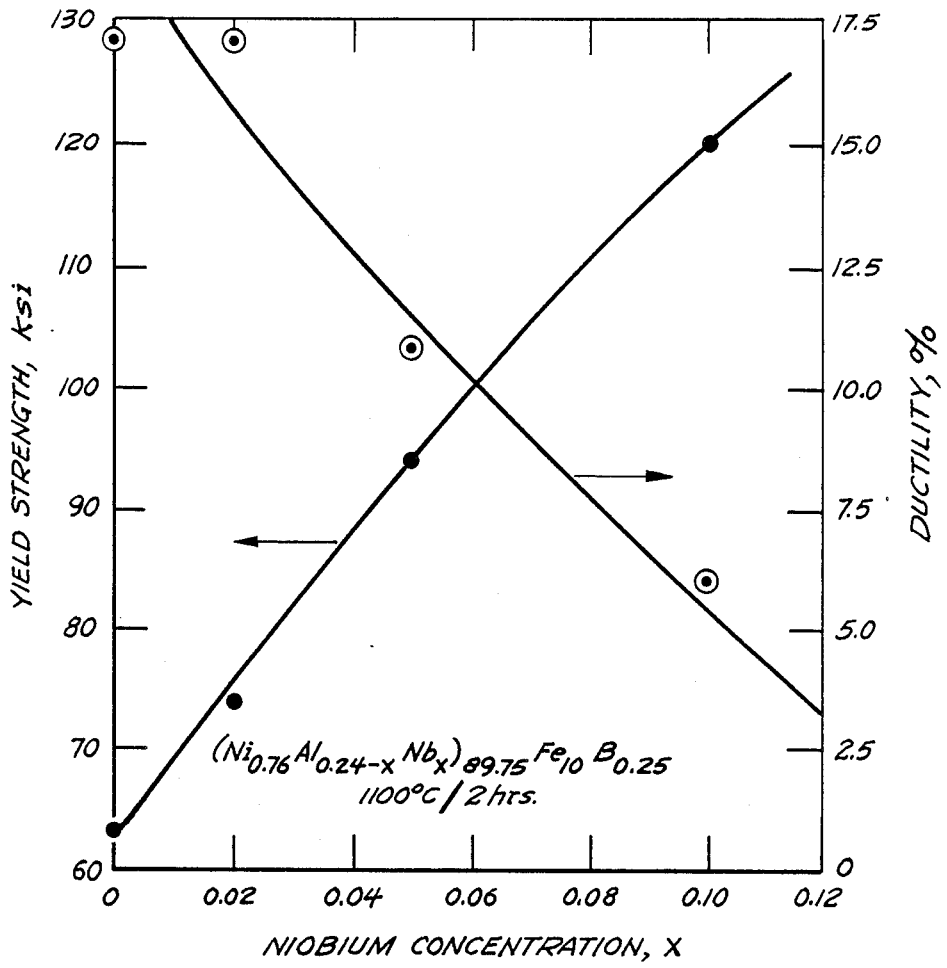
130
120
110
100
90
80
70
60
YIELD STRENGTH, ksi
17.5
15.0
12.5
10.0
7.5
5.0
2.5
0
DUCTILITY, %
0
0.02
0.04
0.06
0.08
0.10
0.12
NIOBIUM CONCENTRATION, X
$(Ni_{0.76}Al_{0.24-x}Nb_x)_{89.75}Fe_{10}B_{0.25}$
1100°C / 2 hrs.

$NI_3A1$ ALLOY OF IMPROVED DUCTILITY BASED ON IRON AND NIOBIUM SUBSTITUENT

BACKGROUND OF THE INVENTION

The present invention relates generally to compositions having a nickel aluminide base for use in high temperature applications. More specifically, it relates to a rapidly solidified tri-nickel aluminide which has improved ductility based on a partial substitution of iron and niobium in the base alloy.

It is known that polycrystalline tri-nickel aluminide castings exhibit properties of extreme brittleness, low strength and poor ductility at room temperature. It is also known that the rapidly solidified tri-nickel aluminide alloy in the absence of low concentrations of boron also exhibits similar properties at room temperature.

The single crystal tri-nickel aluminide in certain orientations does display a favorable combination of properties at room temperature including significant ductility. However, the polycrystalline material which is conventionally formed by known processes, including rapid solidification processing, does not display the desirable properties of the single crystal material and, although potentially useful as a high temperature structural material, has not found extensive use in this application because of the poor properties of the material at room temperature.

For example, it is known that trinickel aluminide has good physical properties at temperatures above 1000° F. and could be employed, for example, in jet engines as component parts for use at operating or higher temperatures. However, if the material does not have favorable properties at room temperature and below, the part formed of the aluminide may break when subjected to stress at the lower temperatures at which the part would be maintained prior to starting the engine and prior to operating the engine at the higher temperatures.

Alloys having a tri-nickel aluminide base are among the group of alloys known as heat-resisting alloys or superalloys. These alloys are intended for very high temperature service where relatively high stresses (tensile, thermal, vibratory and shock) are encountered and where oxidation resistance is frequently required. The nickel aluminide has favorable strength-to-weight ratios for use in aircraft at elevated temperatures and also has favorable oxidation resistance. Various efforts have been made to improve the lack of ductility at lower temperatures.

Accordingly, what has been sought in the field of superalloys is an alloy composition which displays favorable stress resistant properties not only at the elevated temperatures at which it may be used as, for example, in a jet engine but also a practical, desirable and useful set of properties at the lower temperatures to which the engine is subjected in storage and in mounting and starting operations. For example, it is well known that an engine may be subjected to severe subfreezing temperatures while standing on an airfield or runway prior to starting the engine.

Significant efforts have been made toward producing a tri-nickel aluminide and similar superalloys which may be useful over a wide range of temperatures and which are adapted to withstand the stress to which the articles made from the material may be subjected in normal operations over such a wide range of temperatures. Some such efforts have been successful. For example, U.S. Pat. No. 4,478,791, assigned to the same assignee as the subject application teaches a method by which a significant measure of ductility can be imparted to a tri-nickel aluminide base metal at room temperature to overcome the brittleness of this material.

Also, copending application of the same inventors of the subject application, Ser. Nos. 647,327; 647,326; 647,328; 647,877 and 647,879, filed Sept. 4, 1984, teaches methods by which the composition and methods of U.S. Pat. No. 4,478,791may be improved.

The subject application presents a method and composition for incorporating improvements in the properties of a tri-nickel aluminide over the composition of the U.S. Pat. No. 4,478,791.

Also, copending application Ser. No. 647,328, filed Sept. 4, 1984, teaches a composition and method for improving the properties of nickel aluminide and involves the incorporation of iron in the nickel aluminide as a partial substituent for both nickel and aluminum. The subject application is an improvement over the teaching of the 647,328 application. Each of the applications enumerated above and the 4,478,781 patent are incorporated herein by reference.

BRIEF SUMMARY OF THE INVENTION

It is one object of the present invention to provide a method of forming a nickel aluminide base article adapted for use in structural parts over a very broad range of temperatures up to about 600° C. and above.

Another object is to provide a nickel aluminide base article suitable for withstanding significant degrees of stress and for providing appreciable ductility over the broad range of temperatures up to 600° C. and above.

Another object is to provide a consolidated nickel aluminide material which can be formed into useful parts having a desirable combination of properties of significant strength and ductility over a broad range of temperatures up to 600° C. and above.

Another object is to provide a consolidated material which is suitable for cold rolling, extrusion and isothermal forming.

Another object is to provide a nickel aluminide base material having significantly improved ductility at the lower temperatures at which nickel aluminide is known to have low ductility.

Other objects will be in part apparent and in part pointed out in the description which follows.

In one of its broader aspects, objects of the invention can be achieved by providing a melt of a nickel aluminide containing a boron additive and also containing an iron substituent which substitutes in part for the nickel of the nickel aluminide and also substitutes in part for the aluminum of the nickel aluminide and further containing niobium as a partial substituent for the aluminum. The melt is rapidly solidified. It can be conveniently rapidly solidified into ribbon in a laboratory. For commercial application it can be rapidly solidified into powder by conventional gas atomization means and can then be consolidated into a useful article.

Although the melt referred to above should ideally consist only of the atoms of the intermetallic phase and atoms of carbon and boron, it is recognized that occasionally and inevitably other atoms of one or more incidental impurity atoms may be present in the melt.

As used herein, the expression tri-nickel aluminide basd composition refers to a tri-nickel aluminide which contains impurities which are conventionally found in nickel aluminide compositions. It includes as well other constituents and/or substituents which do not detract from the unique set of favorable properties which are achieved through practice of the present invention.

BRIEF DESCRIPTION OF THE DRAWINGS

FIG. 1 is a graph showing the yield strength plotted as the left ordinate and ductility in percent elongation plotted as the right ordinate against the niobium content in percent of a series of samples which were rapidly solidified ribbon. The ribb n samples were each annealed for 2 hours at about 1100° C. In this figure, the niobium concentration is plotted as the absissa and is the x of the following equation:

$$(Ni_{0.76}Al_{0.24-x}Nb_x)_{89.75}Fe_{10}B_{0.25}.$$

The subscripts for the expression $(Ni_{0.76}Al_{0.24-x}Nb_x)$; as well as for the iron; and also for the boron, are given in atomic percent.

DETAILED DESCRIPTION OF THE INVENTION

In their studies of the Ni-Fe-Al ternary system, A. J. Bradley (Journal of Iron and Steel Institute, September 1949, pages 19–30) and V. G. Rivlin and G. V. Raynor (International Metal Reviews, Vol. 79, 1980, pages 79–93) showed that iron substitutes for both nickel and aluminum in the ternary system. However, there is no hint, suggestion or speculation regarding any of the properties or performance characteristics of any of the materials reported in the article. Also, there was no reference whatever to boron doping or to rapid solidification of any of the compositions which were reported.

More recently, C. T. Liu et al. reported that "the strength of $Ni_3Al$ can be substantially increased by solid-solution hardening with 10 to 15 atomic percent iron". However, Liu makes no reference whatever to the ductility of the iron modified aluminide. Also, Liu did not use and did not suggest use or usefulness of rapid solidification in connection with the aluminide or with the iron modified aluminide. This Liu article appeared in the Proceedings of the Electrochemical Society on High Temperature Materials edited by M. Cubicciotti, Vol. 83–7, Electrochemical Society Inc., 1983, page 32. As shown in FIG. 6 of this Electrochemical Society publication, room temperature yield strength was reported at about 500 MPa for an alloy labelled as $Ni_3Al+Fe+$dopants. This was compared with a room temperature yield strength of about 300 MPa for an alloy labeled as $Ni_3Al+B$ at a boron concentration of about 0.05% in weight percent (~0.25% in atom percent). No ductility behavior of the iron-containing alloy was reported. To change the MPa weights to psi, or to ksi, the following formula is employed:

$$7MPa = 1000\ psi = 1\ ksi$$

Further, there was no disclosure in any of these publications of the possibility of improving the performance of boron doped iron bearing nickel aluminide of any sort by further substitution of niobium for aluminum in such a composition.

Yet we have now found that a niobium substituent can be employed in place of a portion of the aluminum of the aluminide and in cooperation with an iron substituent, can yield compositions having a unique and desirable combination of tensile strength and ductility.

The manner in which this has been accomplished will be made additionally clear from the description of examples and plot of the experimental data which follows.

EXAMPLE 1

An alloy identified as Alloy 112 was prepared to contain a small percentage of niobium according to the following formula:

$$(Ni_{0.75}Al_{0.20}Nb_{0.05})_{99}B_{1.0}.$$

A heat of the composition was prepared, cast and comminuted. About 60 grams of the pieces were delivered into an alumina crucible of a chill-block melt spinning apparatus. The crucible terminated in a flat-bottomed exit section having a slot 0.25 (6.35 mm) inches by 25 mils (0.635 mm) therethrough. A chill block, in the form of a wheel having faces 10 inches (25.4 cm) in diameter with a thickness (rim) of 1.5 inches (3.8cm), made of H-12 tool steel, was oriented vertically so that the rim surface could be used as the casting (chill) surface when the wheel was rotated about a horizontal axis passing through the centers of and perpendicular to the wheel faces. The crucible was placed in a vertically up orientation and brought to within about 1.2 to 1.6 mils (30–40$\mu$) of the casting surface with the 0.25 inch length dimension of the slot oriented perpendicular to the direction of rotation of the wheel.

The wheel was rotated at 1200 rpm, the melt was heated to between about 1350° and 1450° C. and ejected as a rectangular stream onto the rotating chill surface under the pressure of argon at about 1.5 psi to produce a long ribbon which measured from about 40–70$\mu$ in thickness by about 0.25 inches in width.

It was found that with the combination of the niobium and rapid solidification, an as-cast ribbon bend ductility of 0.02 was found. A value of 1.0 for the ribbon bend ductility test is a measure of full bending without fracture and this degree of bending is exhibited by a base alloy of $(Ni_{0.75}Al_{0.25})_{99}B_1$ when prepared as rapidly solidified ribbon according to the teachings of U.S. Pat. No. 4,478,791. This patent is incorporated herein by reference.

This value of 0.02 is not acceptable as establishing that a material is a ductile material. Ductility is measured as the of elongation which a material will undergo under certain conventional test conditions known in the art. Experience in testing such materials has shown that a tensile test of a material having a ribbon bend ductility test result of less than 1.0 inevitably results in a ductility or elongation measurement of about zero.

The microstructure of the niobium modified alloy of tri-nickel aluminide showed evidence of second phase formation.

The material was subjected to heat treatment at 1100° C. for two hours. A ribbon bend ductility test was then performed and it was found that the value determined was not better than the 0.02 value originally obtained as set forth above.

EXAMPLE 2

The procedure of Example 1 was repeated but in this case a melt was employed having a composition according to the following expression:

$$(Ni_{0.76}Al_{0.24})_{89.75}Fe_{10}B_{0.25}.$$

The alloy of this composition was melt spun as described in Example 1.

A bend test was performed on the ribbon product and a value of 1.0 was obtained.

The specimen ribbons were annealed at 1100° C. for 2 hours. The annealing at 1100° C. for 2 hours was a test as explained in Examples 3, 4 and 5 below.

The tensile and ductility properties of the ribbon were determined at room temperature.

The data obtained is plotted in FIG. 1 and the data points appear on the graph of FIG. 1 where the niobium concentration is zero.

The values for the yield strength reported and plotted in FIG. 1 are the values measured at 0.2 percent elongation.

The yield strength values may be compared to those in copending application Ser. No. 647,328, filed Sept. 4, 1984, and assigned to the same assignee as the subject application. The composition of the samples of the copending application are an iron substituted trinickel aluminide according to the expression. As is evident from the text of this copending application, the measurements made were for a sample contaiing 1.0 atomic percent boron. For this reason, the yield strength value found is higher for the sample of the copending application than it is in the sample of this example. The measurement of concern in the copending application is that made at 0.24 concentration of aluminum and is about 87 ksi. The corresponding measured value of ductility is about 13%.

EXAMPLES 3–5

Three compositions, one for each of the three Examples 3–5 were prepared in this study. The formula of the prepared alloy compositions is as follows:

$$(Ni_{0.76}Al_{0.24-x}Nb_x)_{89.75}Fe_{10}B_{0.25}.$$

The alloys identified by numbers Alloys 264 through Alloys 266 contained varying percentages, x, of niobium as follows:

| Example | Alloy No. | Niobium Concentration X |
|---|---|---|
| 3 | 264 | 0.02 |
| 4 | 265 | 0.05 |
| 5 | 266 | 0.10 |

Alloys of the respective compositions were prepared and the alloys wdre melt spun by conventional practice into rapidly solidified ribbons in a vacuum.

A bend test was performed on each ribbon product and a value of 1 was obtained for all samples tested.

The respective batches of ribbon for each example were annealed at 1100° C. for 2 hours. The annealing at 1100° C. for 2 hours is a test of whether the ribbons could withstand the annealing which is incident to being consolidated by high temperature isostatic pressing or other conventional consolidation techniques. The batches of ribbon of these examples were annealed at 1100° C. but were not isostatically or otherwise pressed.

The microstructure of the respective samples were studied by metallography or electron microscopy. Metallography results indicated a limit for single-phase structure between x=0.05 and 0.10. The mechanical properties were determined by tensile tests at room temperature. The results of the tensile tests at room temperature are given in FIG. 1.

It is evident from the data plotted in FIG. 1 that the combination of iron and niobium substituents in the $Ni_3Al$ system result in an alloy having high values of ductility and yield strength in spite of the fact that the compositions contain low concentration of boron (0.25 atomic %).

It is readily evident that the addition of niobium, which from Example 1 was found to induce brittleness in the boron doped composition of Example 1, is surprisingly found to add substantial strength to the iron substituted boron doped trinickel aluminide of Example 2, while retaining acceptable ductility.

For example, the addition of only 0.05 of niobium as in Example 4 results in a remarkable increase of 50% in strength while still maintaining a relative high level of ductility.

Also, the addition of 0.10 of niobium according to the expression of FIG. 1 resulted in a doubling of the yield strength of the composition free of niobium while still maintaining an adequate level of ductility.

What is claimed and sought to be protected by Letters Patent of the United States is as follows:

1. As a composition of matter, a rapidly solidified $\gamma'$ trinickel aluminide base alloy of the following composition, the ingredients of which are given in atomic percent, $$(Ni_{0.76}Al_{0.24-x}Nb_x)_{89.75}Fe_{10}B_{0.25}$$

wherein x of the above formula is between 0.02 and 0.10.

2. The composition of claim 1 in which x is 0.04 to 0.08.

3. The method of preparing a $\gamma'$ phase iron and niobium substituted tri-nickel aluminide base alloy which comprises preparing a composition, the ingredients of which are given in atomic percent, as follows:

$$(Ni_{0.76}Al_{0.24-x}Nb_x)_{89.75}Fe_{10}B_{0.25}$$

wherein x is between 0.02 and 0.10, preparing a melt of the composition and rapidly solidifying the melt.

4. The method of claim 3 in which the x is 0.04 to 0.08.

5. The method of claim 3 in which the rapidly solidified tri-nickel aluminide material is first prepared and is then consolidated.

6. The method of claim 3 in which the rapidly solidified composition is consolidated by heating and pressing.

7. As a composition of matter, a rapidly solidified single phase $\gamma'$ trinickel aluminide base alloy of the following composition, the ingredients of which are given in atomic percent:

$$(Ni_{1-u}Al_{u-x}Nb_x)_{90-y-z}Fe_yB_z,$$

where u is 0.23 to 0.245; y is 5 to 15; z is 0.1 to 2.0; and x is 0.02 to 0.10.

* * * * *